US010301764B2

(12) United States Patent
Woodham, Jr.

(10) Patent No.: US 10,301,764 B2
(45) Date of Patent: May 28, 2019

(54) DRYER APPLIANCES WITH IMPROVED VENT DUCTS

(71) Applicant: Haier US Appliance Solutions, Inc., Wilmington, DE (US)

(72) Inventor: Richard Gary Woodham, Jr., Taylorsville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 184 days.

(21) Appl. No.: 15/478,403

(22) Filed: Apr. 4, 2017

(65) Prior Publication Data

US 2018/0282933 A1 Oct. 4, 2018

(51) Int. Cl.
*D06F 58/22* (2006.01)

(52) U.S. Cl.
CPC ..... *D06F 58/22* (2013.01)

(58) Field of Classification Search
CPC ..... D06F 58/22
USPC ..... 34/82
See application file for complete search history.

(56) References Cited

U.S. PATENT DOCUMENTS 3,043,015 A * 7/1962 Brucken ..... D06F 58/22 34/527
5,535,478 A * 7/1996 Thompson ..... A47L 9/02 15/395
5,940,986 A * 8/1999 Jelinek ..... D06F 58/04 34/528
6,038,732 A * 3/2000 McKnight ..... A47L 9/02 15/321
6,080,243 A * 6/2000 Insley ..... A47L 9/02 134/21
6,481,047 B1 * 11/2002 Schaefer ..... A47L 7/00 15/314
7,325,332 B2 2/2008 Chung et al.
7,644,515 B2 * 1/2010 Doh ..... D06F 58/22 34/603
7,992,322 B2 * 8/2011 Kim ..... D06F 58/04 126/85 B
8,015,726 B2 * 9/2011 Carow ..... D06F 58/28 34/381
8,434,243 B2 * 5/2013 Kim ..... D06F 39/005 34/606
8,713,813 B2 * 5/2014 Sans Rovira ..... D06F 58/22 134/42
9,951,464 B2 * 4/2018 Lee ..... D06F 58/02
10,100,459 B2 * 10/2018 Groppel ..... D06F 58/20
(Continued)

FOREIGN PATENT DOCUMENTS

KR 20120066549 A * 6/2012 ..... D06F 58/04
WO WO-2010092195 A1 * 8/2010 ..... D06F 58/20

*Primary Examiner* — Stephen M Gravini
(74) *Attorney, Agent, or Firm* — Dority & Manning, P.A.

(57) ABSTRACT

A vent duct for a dryer appliance includes a grill, the grill including an outer sidewall and an inner edge. The inner edge defines a first opening. The outer sidewall defines a second opening and a plurality of grating apertures. Each of the plurality of grating apertures has a surface area that is smaller than a surface area of the first opening and the second opening. The vent duct further includes a screen filter removably insertable in the first opening. The screen filter includes a cover and a filter. The vent duct further includes a cover panel, the cover panel removably positionable on the second opening.

17 Claims, 8 Drawing Sheets

(56) References Cited

U.S. PATENT DOCUMENTS

| | | | | |
|---|---|---|---|---|
| 2007/0144028 | A1* | 6/2007 | Audet | D06F 58/22<br>34/82 |
| 2012/0144687 | A1* | 6/2012 | Yeom | D06F 58/04<br>34/82 |
| 2017/0254015 | A1* | 9/2017 | Duckworth | D06F 58/28 |
| 2018/0282933 | A1* | 10/2018 | Woodham, Jr. | D06F 58/22 |

* cited by examiner

DRYER APPLIANCES WITH IMPROVED VENT DUCTS

FIELD OF THE INVENTION

The present subject matter relates generally to dryer appliances, and more particularly to dryer appliances which include improved vent ducts.

BACKGROUND OF THE INVENTION

Dryer appliances generally include a cabinet with a drum mounted therein. In many dryer appliances, a motor rotates the drum during operation of the dryer appliance, e.g., to tumble articles located within a chamber defined by the drum. Alternatively, dryer appliances with fixed drums have been utilized. Typical dryer appliances also generally include a heater assembly that passes heated air through the chamber of the drum in order to dry moisture-laden articles disposed within the chamber. This internal air then passes from the chamber through a vent duct to an exhaust conduit, through which the air is exhausted from the dryer appliance. Typically, a blower (also known as an air handler) is utilized to flow the internal air from the vent duct to the exhaust duct. When operating, the blower may pull air through itself from the vent duct, and this air may then flow from the blower to the exhaust conduit.

A screen filter is typically positioned within the vent duct to collect particulate, such as lint, during operation of the dryer appliance. Such screen filters prevent this particulate from becoming clogged in downstream portions of the vent duct or exhaust conduit or being exhausted into the ambient environment.

However, concerns exist with known vent ducts. For example, in many cases, some particulate becomes lodged in the vent duct and does not adhere to the screen filter. This particulate remains in the vent duct even after removal and cleaning of the screen filter. Such particulate can eventually clog the vent duct, and in some cases can result in dangerous conditions such as fires. Further, access to the vent duct to remove such particulate is restricted, thus making cleaning of such particulate difficult.

Accordingly, improved dryer appliances and associated vent ducts are desired. In particular, vent ducts which provide improved access for particulate cleaning would be advantageous.

BRIEF DESCRIPTION OF THE INVENTION

In accordance with one embodiment of the present disclosure, a dryer appliance is provided. The dryer appliance includes a cabinet defining an interior, and a drum positioned within the interior, the drum defining a chamber for receipt of articles for drying. The dryer appliance further includes an outlet assembly for exhausting air from the chamber. The outlet assembly includes a vent duct, the vent duct including a grill and a screen filter removably positionable within the grill. The grill includes an outer sidewall and an inner edge, the inner edge defining a first opening. The screen filter is removably insertable in the first opening. The outer sidewall defines a second opening and a plurality of grating apertures. Each of the plurality of grating apertures has a surface area that is smaller than a surface area of the first opening and the second opening. The vent duct further includes a cover panel, the cover panel removably positionable on the second opening.

In accordance with another embodiment of the present disclosure, a vent duct for a dryer appliance is provided. The vent duct includes a grill, the grill including an outer sidewall and an inner edge. The inner edge defines a first opening. The outer sidewall defines a second opening and a plurality of grating apertures. Each of the plurality of grating apertures has a surface area that is smaller than a surface area of the first opening and the second opening. The vent duct further includes a screen filter removably insertable in the first opening. The screen filter includes a cover and a filter. The vent duct further includes a cover panel, the cover panel removably positionable on the second opening.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
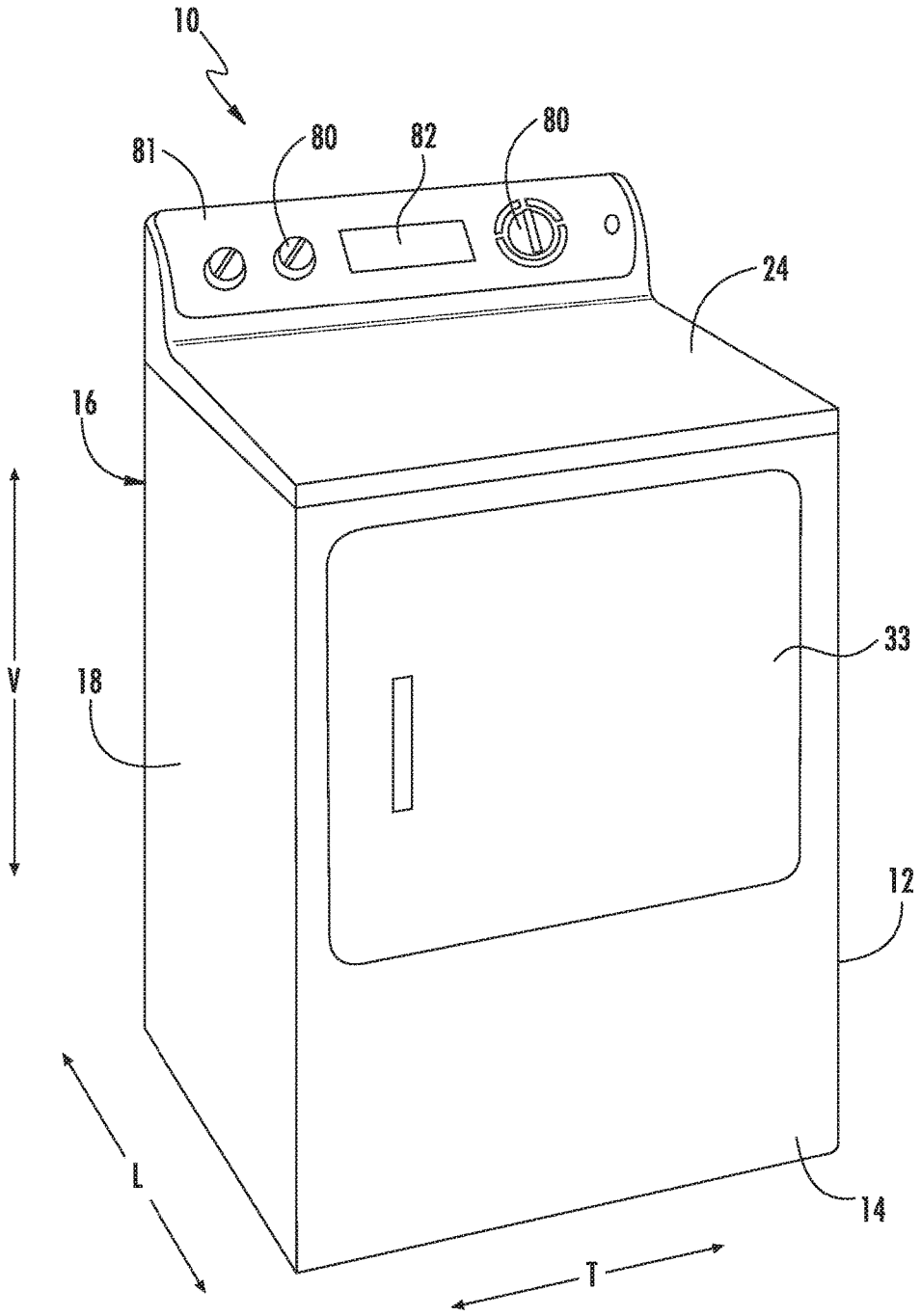
FIG. 1 provides a perspective view of a dryer appliance in accordance with embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
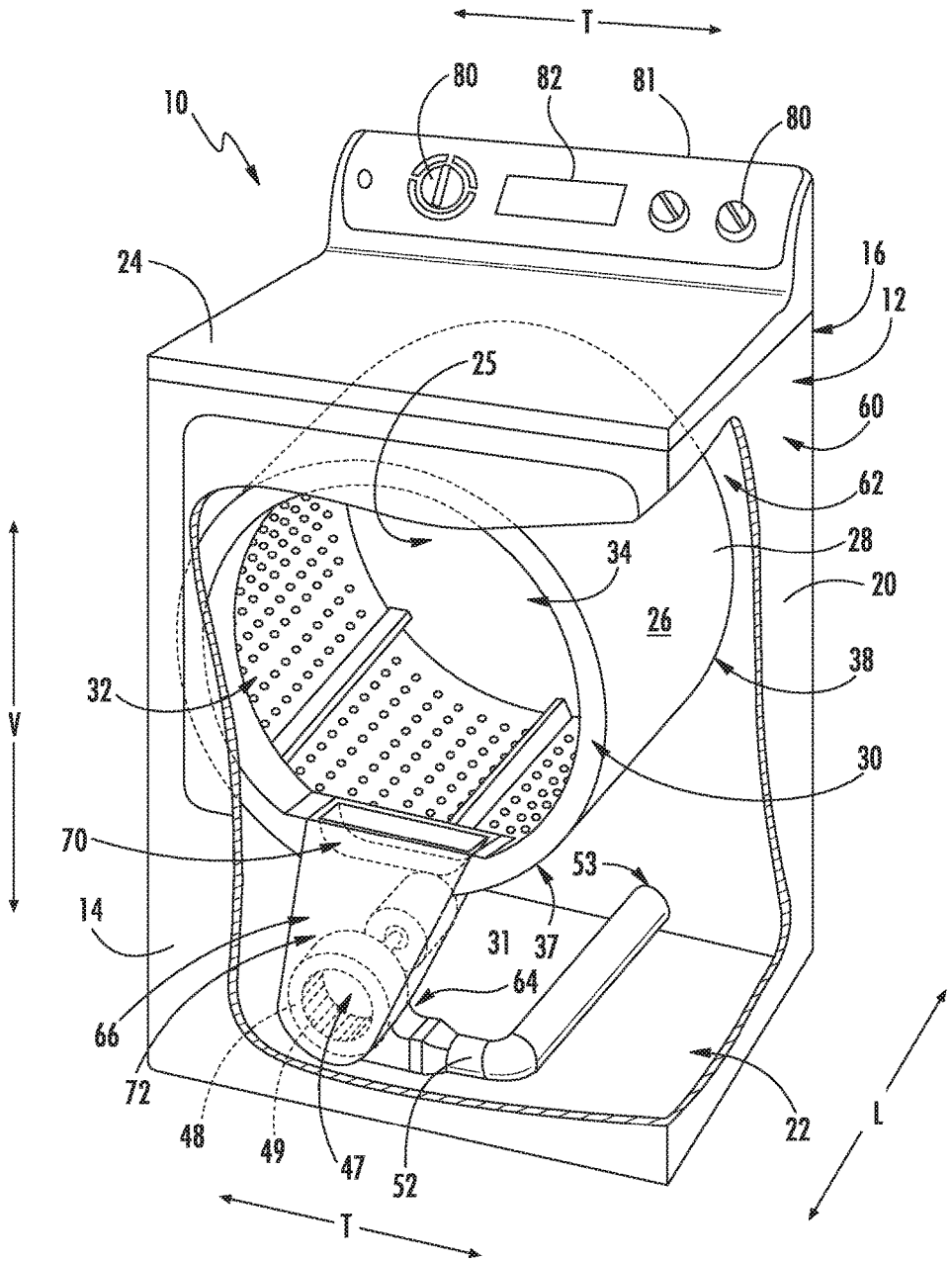
FIG. 2 provides a perspective view of the dryer appliance of FIG. 1 with portions of a cabinet of the dryer appliance removed to reveal certain components of the dryer appliance.

FIG. 1 illustrates a dryer appliance 10 according to an exemplary embodiment of the present subject matter. FIG. 2 provides another perspective view of dryer appliance 10 with a portion of a cabinet or housing 12 of dryer appliance 10 removed in order to show certain components of dryer appliance 10. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. Dryer appliance 10 defines a vertical direction V, a lateral direction L, and a transverse direction T. The vertical direction V, lateral direction L, and transverse direction T are mutually perpendicular and form and orthogonal direction system.

Cabinet 12 includes a front panel 14, a rear panel 16, a pair of side panels 18 and 20 spaced apart from each other by front and rear panels 14 and 16, a bottom panel 22, and a top cover 24. These panels and cover collectively define an external surface 60 of the cabinet 12 and an interior 62 of the cabinet. Within interior 62 of cabinet 12 is a drum or container 26. Drum 26 defines a chamber 25 for receipt of articles, e.g., clothing, linen, etc., for drying. Drum 26 extends between a front portion 37 and a back portion 38, e.g., along the lateral direction L. In exemplary embodiments the drum 26 is rotational. Alternatively, however, the drum 26 may be fixedly mounted within the interior 62.

Drum 26 is generally cylindrical in shape, having an outer cylindrical wall or cylinder 28 and a front wall 30 that may define an entry 32 of drum 26, e.g., at front portion 37 of drum 26, for loading and unloading of articles into and out of chamber 25 of drum 26. Drum 26 also includes a back or rear wall 34, e.g., at back portion 38 of drum 26. As is generally understood, the front wall 30 and rear wall 34 remain generally stationary during operation of the dryer appliance 10. The cylinder 28 is rotatable relative to the drum 26 (including the front wall 30 and rear wall 34), such as about a central longitudinal axis of the cylinder 28 which in exemplary embodiments as shown extends parallel to the lateral direction L. In alternative embodiments, entry 32 may be defined in top cover 24, and front wall 30 may be a generally solid wall.

A motor 31 may be in mechanical communication with a blower or air handler 48 such that motor 31 rotates a fan 49, e.g., a centrifugal fan, of air handler 48. Air handler 48 is configured for drawing air through chamber 25 of drum 26, e.g., in order to dry articles located therein as discussed in greater detail below. In alternative exemplary embodiments, dryer appliance 10 may include an additional motor (not shown) for rotating fan 49 of air handler 48 independently of drum 26.

Drum 26 may be configured to receive heated air that has been heated by a heater, e.g., in order to dry damp articles disposed within chamber 25 of drum 26. As discussed above, during operation of dryer appliance 10, motor 31 rotates fan 49 of air handler 48 such that air handler 48 draws air through chamber 25 of drum 26. Ambient air that is heated by the heater may thus be drawn into chamber 25 of drum 26. Within chamber 25, the heated air can remove moisture, e.g., from damp articles disposed within chamber 25. This internal air in turn flows from the chamber 25 through an outlet assembly 64 positioned within the interior 62. The outlet assembly 64 includes a vent duct 66 and an exhaust conduit 52. The exhaust conduit 52 is in fluid communication with the vent duct 66. During a dry cycle, internal air flows from the chamber 25 through the vent duct 66 to the exhaust conduit 52, and is exhausted from the exhaust conduit 52. As shown, the internal air can for example flow from the vent duct 66 through an exit conduit 47 defined in the vent duct 66 and air handler 48 to the exhaust conduit 52.

In exemplary embodiments, vent duct 66 can include a filter portion 70 and an exhaust portion 72. The exhaust portion 72 may be positioned downstream of the filter portion 70 (in the direction of flow of the internal air). A screen filter of filter portion 70 (which may be removable) traps lint and other particulates as the internal air flows therethrough. The internal air may then flow through the exhaust portion 72 and to the exhaust conduit 52, such as through the exit conduit 47.

After the clothing articles have been dried, they are removed from the drum 26 via entry 32. A door 33 provides for closing or accessing drum 26 through entry 32.

A cycle selector knob 80 is mounted on a cabinet backsplash 81 and is in communication with a processing device or controller 82. Signals generated in controller 82 operate the motor 31 and heaters (discussed herein) in response to the position of selector knobs 80. Alternatively, a touch screen type interface may be provided. As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements such as e.g., electrically erasable, programmable read only memory (EEPROM).

It should be understood that, while FIGS. 1 and 2 illustrate embodiments wherein dryer assembly 10 is a horizontal axis dryer assembly, in other embodiments dryer assembly 10 may be, for example, a vertical axis dryer assembly or another suitable dryer assembly. In a vertical axis dryer assembly 10, for example, cylinder 28 of drum 26 may extend along the vertical axis V between rear wall 34 and front wall 30. Accordingly, the present disclosure is not limited to horizontal axis dryer assemblies. Rather, any suitable dryer assembly is within the scope and spirit of the present disclosure.

Figure 3:
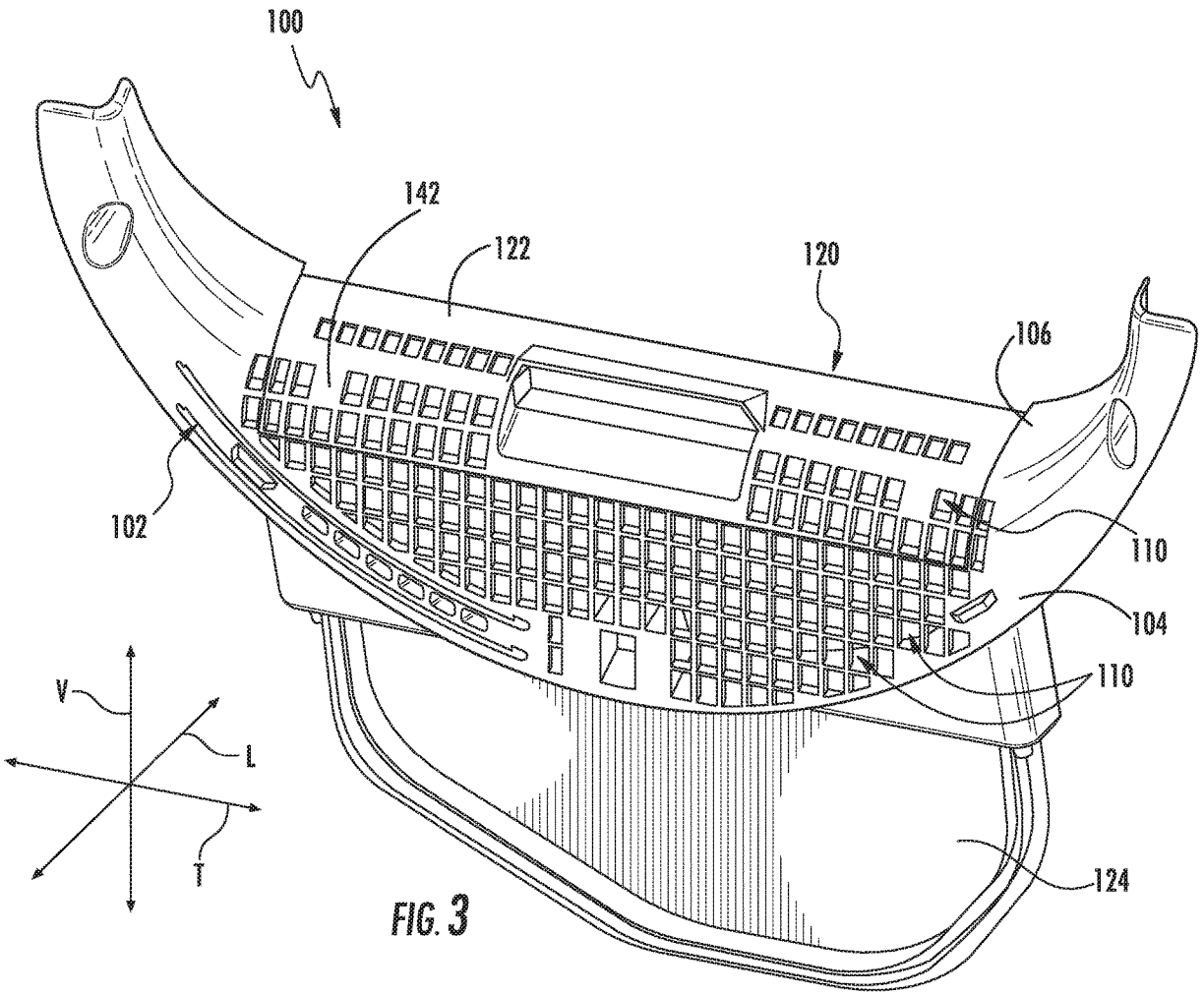
FIG. 3 provides a perspective view of a vent duct of a dryer appliance with a screen filter and cover panel in assembled positions in accordance with embodiments of the present disclosure.

Referring now to FIG. 3, embodiments of improved vent ducts 100, which may be vent ducts 66 of dryer appliances 10, in accordance with the present disclosure are provided. A vent duct may, for example, be a component of an outlet assembly 64 as discussed herein. Vent ducts 100 in accordance with the present disclosure advantageously provide additional openings for access to particulate therein, and in particular may provide openings having suitable sizing to allow vacuum access therein to clean the particulate therefrom. Accordingly, a user may advantageously be able to easily access such openings and remove particulate, thus reducing the risk of clogging and other dangerous conditions.

As illustrated, vent duct 100 may include a grill 102. Grill 102 may be or provide a component of the front wall 30. The grill 102 may include an outer sidewall 104 and an inner edge 106. Inner edge 106 may partially define the entry 32. A plurality of grating apertures 110 may be defined in the outer sidewall 104, as shown. These apertures 110 may be relatively small apertures in, for example, a honeycomb or other suitable pattern, which allow for airflow through the grill 102. Each aperture 110 may have a surface area which defines the size of the aperture at an exterior surface of the outer sidewall 104.

Inner edge 106 may be angled to and in some cases approximately or generally perpendicular to the outer sidewall 104. In some embodiments, a curved transition portion of the outer sidewall 104 may provide a transition between the inner edge 106 and the outer sidewall 104. A first opening 112 may be defined in the inner edge 106. First opening 112 may provide access for the insertion of a screen filter 120, as discussed herein. First opening 112 may be relatively large as compared to apertures 110, and may have a surface area which defines the size of the first opening 112 at an exterior surface of the inner edge 106. The surface area of each aperture 110 may be smaller than the surface area of the first opening 112.

Figure 4:
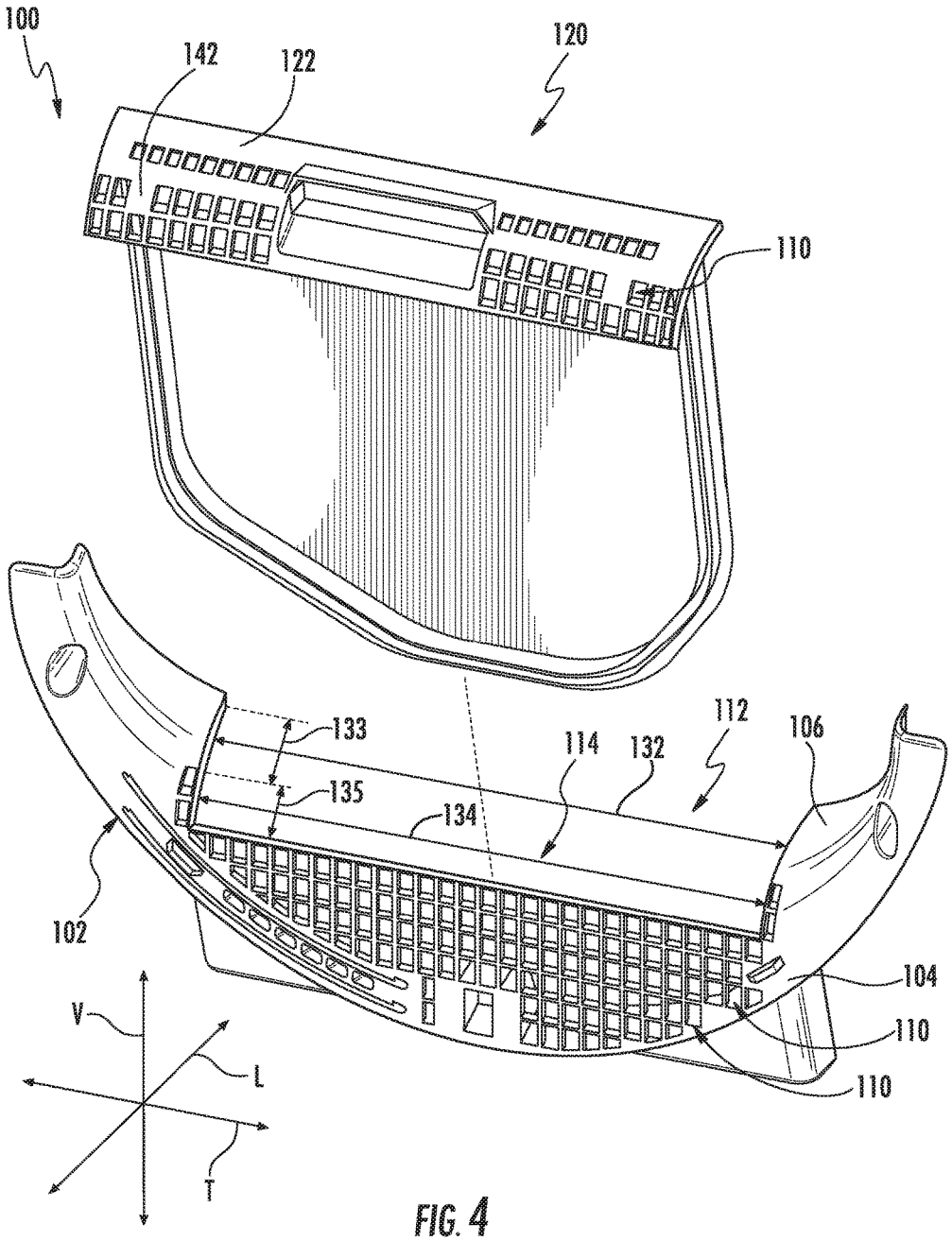
FIG. 4 provides the vent duct of FIG. 3 with the screen filter and cover panel in disassembled positions in accordance with embodiments of the present disclosure.
Figure 5:
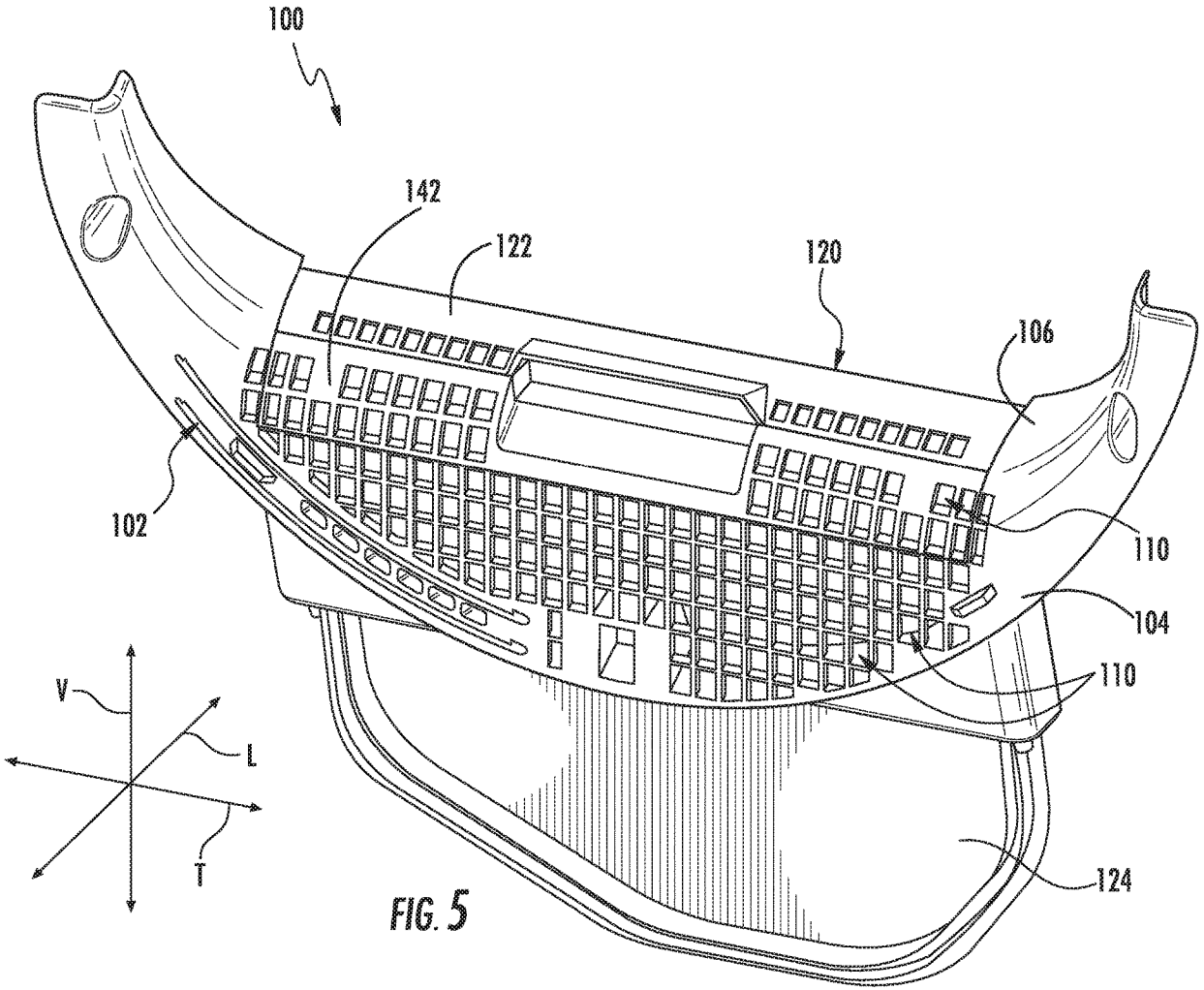
FIG. 5 provides a perspective view of a vent duct of a dryer appliance with a screen filter and cover panel in assembled positions in accordance with embodiments of the present disclosure.
Figure 6:
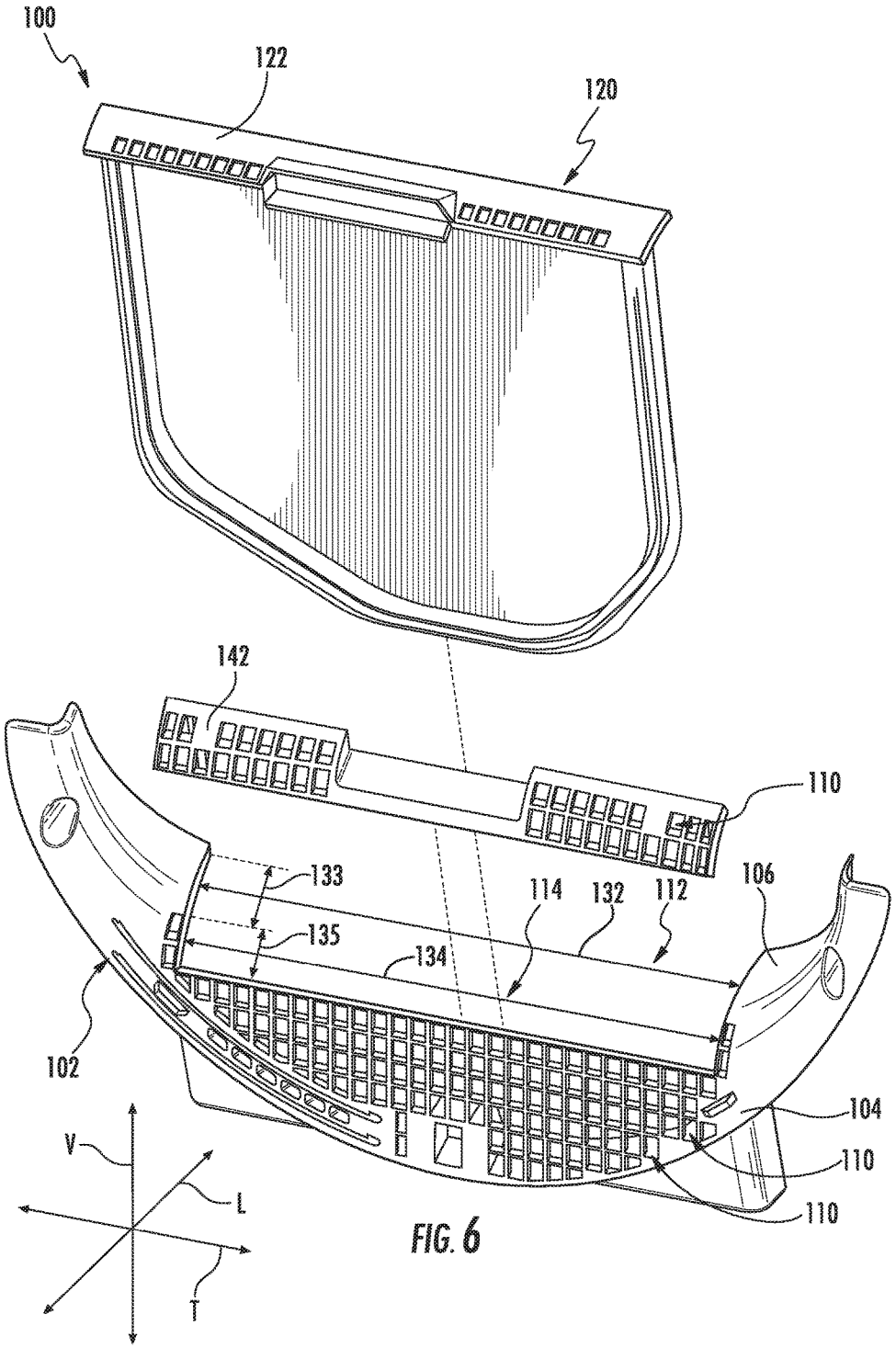
FIG. 6 provides the vent duct of FIG. 5 with the screen filter and cover panel in disassembled positions in accordance with embodiments of the present disclosure.
Figure 7:
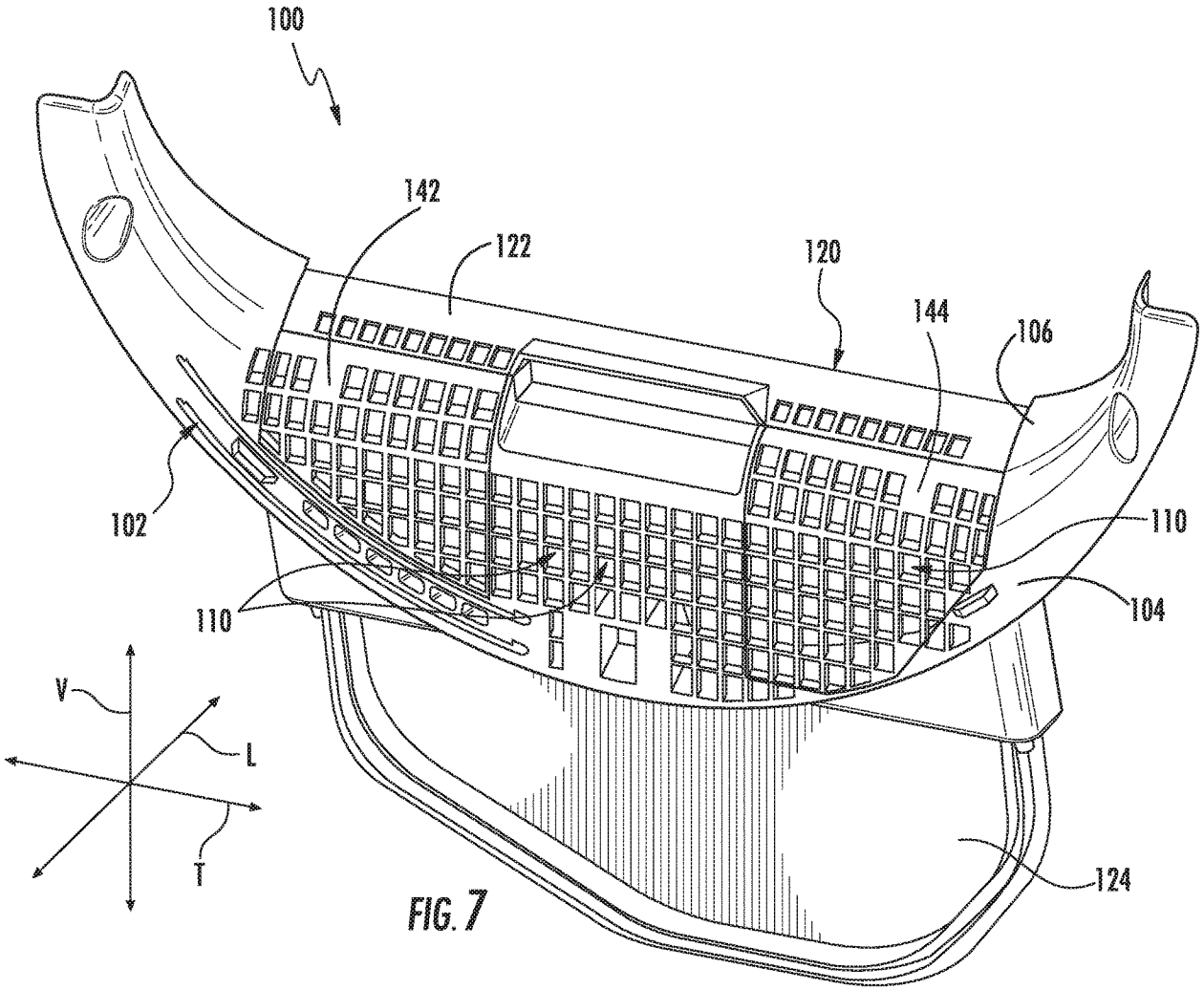
FIG. 7 provides a perspective view of a vent duct of a dryer appliance with a screen filter and cover panels in assembled positions in accordance with embodiments of the present disclosure.
Figure 8:
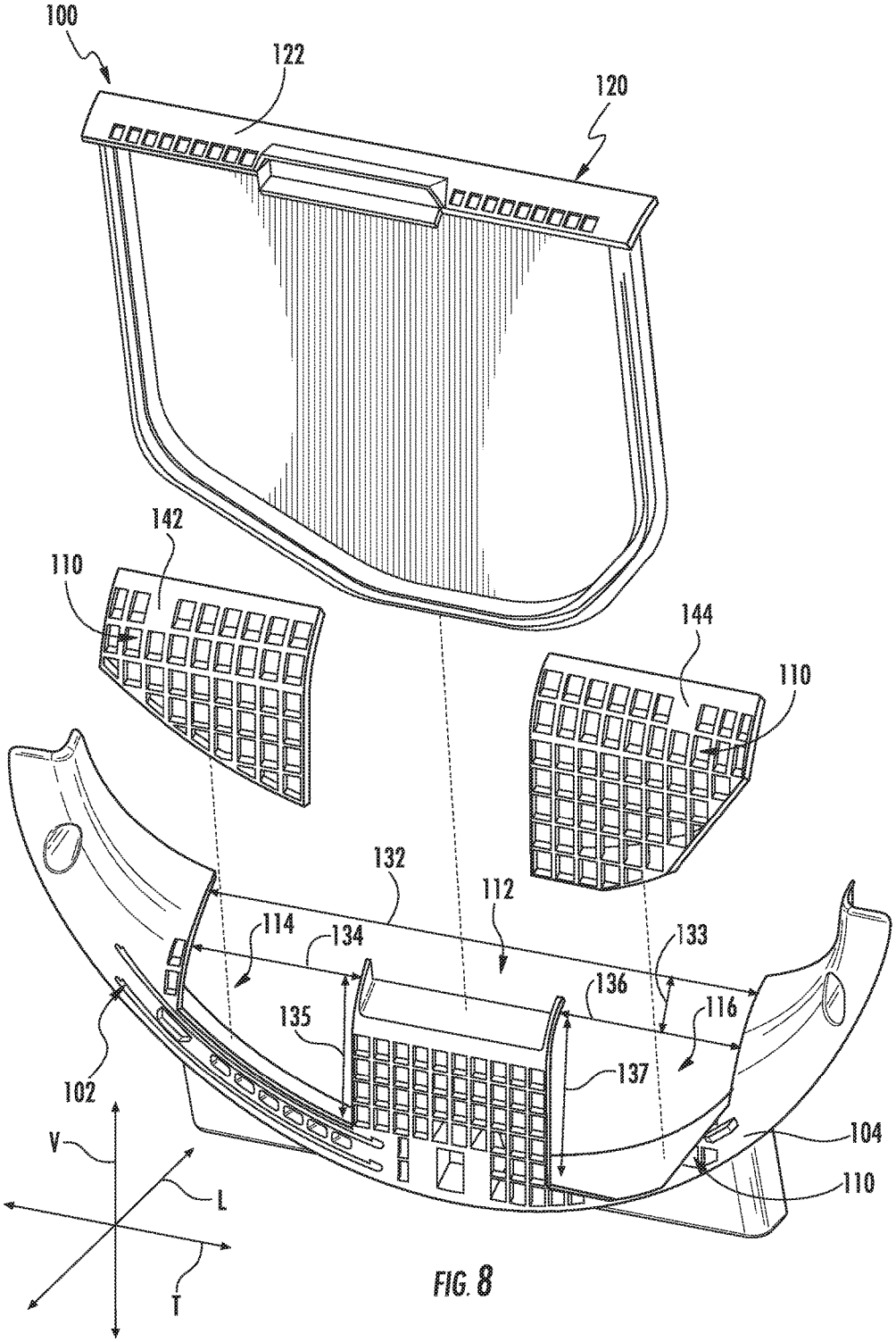
FIG. 8 provides the vent duct of FIG. 7 with the screen filter and cover panels in disassembled positions in accordance with embodiments of the present disclosure.

As shown, a screen filter 120 may be removably positionable within the grill 102. For example, screen filter 120 may be removably insertable in the first opening 112. FIGS. 3, 5, and 7 illustrate the screen filter 120 inserted in the grill 102 and thus in an assembled position, while FIGS. 4, 6, and 8 illustrate the screen filter 120 removed from the grill 102 and thus in a disassembled position. Screen filter 120 may include a cover 122 and a filter 124. Filter 124 may define filter apertures which have surface areas smaller than those of apertures 110, and which facilitate the interception and filtering of particulate such as lint, as is generally understood. Cover 122 may be connected to an end of filter 124, and may provide a handle for a user to grasp when removing and inserting the screen filter 120. When the screen filter 120 is inserted, the filter 124 may be disposed within grill 102 and the cover 122 may be disposed within first opening 112, as shown. When the screen filter 120 is removed, the filter 124 may be removed from the grill 102 and the first opening 112 may be exposed.

Outer sidewall 104 may further include one or more openings, such as a second opening 114 and, optionally, a third opening 116 as shown. Such openings 114, 116 may each be relatively large as compared to apertures 110, and may have a surface area which defines the size of the opening 114, 116 at an exterior surface of the outer sidewall 104. The surface area of each aperture 110 may be smaller than the surface area of each opening 114, 116. Openings 114, 116 may advantageously facilitate access to within the grill 102 when the screen filter 120 is removed, thus allowing a user, with a vacuum, the user's hand, etc., clean particulate from within grill 102.

In some embodiments, as illustrated, an opening 114, 116 may be in communication with the first opening 112. In these embodiments, the first opening 112 and opening 114, 116 share an open border therebetween. Alternatively, however, an opening 114, 116 may be separate from the first opening 112. In these embodiments, a portion of the outer sidewall 106 may provide a partition between the first opening 112 and the opening 114, 116.

Each opening 112, 114, 116 may have a length 132, 134, 136, respectively, defined in the transverse direction T. Further, each opening 112, 114, 116 may have a width 133, 135, 137, respectively, defined in a direction perpendicular to the transverse direction T and defining with the associated length the surface area of the respective opening 112, 114, 116. In some embodiments, as illustrated in FIGS. 4 and 6, a length 134, 136 may be equal to the length 132. In other embodiments, as illustrated in FIG. 8, a length 134, 136 may be less than the length 132. Further, an opening 114, 116 may in some embodiments have a length 134, 136 that is greater than 1.5 inches, such as greater than or equal to 2 inches, such as between 1.5 inches and 5 inches, such as between 2 inches and 4.5 inches. Additionally or alternatively, an opening 114, 116 may in some embodiments have a length 135, 137 that is greater than 1.5 inches, such as greater than or equal to 2 inches, such as between 1.5 inches and 5 inches, such as between 2 inches and 4.5 inches. Such relatively large lengths and heights may advantageously facilitate improved access through the openings 114, 116 as discussed herein.

One or more cover panels 142, 144 may be provided to selectively cover the openings 114, 116. In some embodiments, as illustrated in FIGS. 3-6, a single cover panel 142 may be provided, such as to selectively cover a second opening 114. In other embodiments, as illustrated in FIGS. 7-8, multiple cover panels 142, 144 may be provided, such as to selectively cover a second opening 114 and a third opening 116. Cover panels 142, 144 may advantageously provide selective access through the openings 114, 116 to allow a user, with a vacuum, the user's hand, etc., to clean particulate from within grill 102.

Each cover panel 142, 144 may be removably positionable on an opening 114, 116. FIGS. 3, 5, and 7 illustrate cover panels 142, 144 positioned on openings 114, 116, and thus in assembled positions. In some embodiments, and in particular when the cover panels 142, 144 are separate from the screen filter 120 as illustrated in FIGS. 5-8 and discussed herein, suitable attachment mechanism, such as snap tabs, etc., may be utilized to connect the cover panels 114, 116 to the outer sidewall 104. FIGS. 4, 6, and 8 illustrate cover panels 142, 144 removed from openings 114, 116, and thus in disassembled positions.

In some embodiments as illustrated, grating apertures 110 may be defined in cover panel(s) 142, 144. Accordingly, when cover panels 142, 144 are positioned on their respective openings 114, 116 in the assembled position, air flow may still be allowed through cover panel(s) 142, 144. However, due to the small size of the grating apertures 110, access inside the grill 102 with a user's hand or a vacuum may be restricted or prevented. In other embodiments, cover panel(s) 142, 144 may be solid, with no apertures therethrough.

In some embodiments, as illustrated in FIGS. 3 and 4, a cover panel 142, 144, such as cover panel 142 as shown, may be integrally formed with the screen filter 120. For example, the cover panel 142, 144 may be integrally formed with the cover 122. In these embodiments, the cover panel 142, 144 and the cover 122 are formed as a single, unitary component. Accordingly, the cover 122 and cover panel(s) 142, 144 may be assembled and disassembled with their respective openings 112, 114, 116 together in a unitary manner.

In alternative embodiments, as shown in FIGS. 5-8, a cover panel 142, 144 may be a separate component. In these embodiments, the cover panel 142, 144 may be assembled and disassembled with its respective opening 114, 116 separate from assembly and disassembly of screen filter 120 with opening 112. Notably, in these embodiments, a cover panel 142, 144 may in the assembled position be connected to the screen filter 120, such as the cover 122 thereof, via suitable attachment mechanism, such as snap tabs, etc. Alternatively, the cover panels 142, 144 may remain unconnected from the screen filter 120.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet defining an interior;

a drum positioned within the interior, the drum defining a chamber for receipt of articles for drying;

an outlet assembly for exhausting air from the chamber, the outlet assembly comprising a vent duct, the vent duct comprising a grill and a screen filter removably positionable within the grill, the grill comprising a sidewall and a top wall, the top wall defining a first opening, wherein the screen filter is removably insertable in the first opening, the sidewall defining a second opening and a first plurality of grating apertures, each of the first plurality of grating apertures having a surface area that is smaller than a surface area of the first opening and the second opening, the vent duct further comprising a cover panel, the cover panel removably positionable on the second opening, wherein the second opening is in communication with the first opening to share an open border therebetween, wherein a length of the second opening is less than or equal to a length of the first opening, and wherein the cover panel defines a second plurality of grating apertures, each of the second plurality of grating apertures having a surface area that is smaller than the surface area of the first opening and the second opening.

2. The dryer appliance of claim 1, wherein the cover panel is separate from the screen filter.

3. The dryer appliance of claim 1, wherein the cover panel is integrally formed with the screen filter.

4. The dryer appliance of claim 3, wherein the screen filter comprises a cover and a filter, and wherein the cover panel is integrally formed with the cover.

5. The dryer appliance of claim 1, wherein the length of the second opening is equal to the length of the first opening.

6. The dryer appliance of claim 1, wherein the length of the second opening is less than the length of the first opening.

7. The dryer appliance of claim 1, wherein the sidewall defines a third opening, wherein each of the first plurality of grating apertures has a surface area that is smaller than a surface area of the third opening.

8. The dryer appliance of claim 7, wherein the cover panel is a plurality of cover panels, each of the plurality of cover panels removably positionable on one of the second opening or the third opening.

9. The dryer appliance of claim 1, wherein the length of the second opening is greater than 1.5 inches.

10. The dryer appliance of claim 1, wherein the second opening has a height of greater than 1.5 inches.

11. A vent duct for a dryer appliance, the vent duct comprising:

a grill, the grill comprising a sidewall and a top wall, the top wall defining a first opening, the sidewall defining a second opening and a first plurality of grating apertures, each of the first plurality of grating apertures having a surface area that is smaller than a surface area of the first opening and the second opening;

a screen filter removably insertable in the first opening, the screen filter comprising a cover and a filter; and a cover panel, the cover panel removably positionable on the second opening, wherein the second opening is in communication with the first opening to share an open border therebetween, wherein a length of the second opening is less than or equal to a length of the first opening, and wherein the cover panel defines a second plurality of grating apertures, each of the second plurality of grating apertures having a surface area that is smaller than the surface area of the first opening and the second opening.

12. The vent duct of claim 11, wherein the cover panel is separate from the screen filter.

13. The vent duct of claim 11, wherein the cover panel s integrally formed with the cover.

14. The vent duct of claim 11, wherein the length of the second opening is equal to the length of the first opening.

15. The vent duct of claim 11, wherein the length of the second opening is less than the length of the first opening.

16. The vent duct of claim 11, wherein the length of the second opening is greater than 1.5 inches.

17. The vent duct of claim 11, wherein the second opening has a height of greater than 1.5 inches.

* * * * *